United States Patent [19]

Clarke

[11] 4,120,399

[45] Oct. 17, 1978

[54] REFILLABLE TABLET PACKAGE

[75] Inventor: John W. Clarke, Indianapolis, Ind.

[73] Assignee: Eli Lilly and Company, Indianapolis, Ind.

[21] Appl. No.: 836,285

[22] Filed: Sep. 26, 1977

[51] Int. Cl.[2] ..... B65D 85/56

[52] U.S. Cl. ..... 206/474; 206/1.5; 206/471; 206/484; 206/539

[58] Field of Search ..... 206/332, 445, 462, 467, 206/468, 471, 472, 473, 474, 475, 484, 488, 489, 531, 532, 538, 534.1, 534.2, 1.5, 539

[56] References Cited

U.S. PATENT DOCUMENTS

| | | | |
|---|---|---|---|
| 3,603,453 | 9/1971 | Serrell et al. | 206/445 |
| 3,659,706 | 5/1972 | Serrell | 206/445 |
| 3,737,029 | 6/1973 | Serrell et al. | 206/467 |
| 3,912,082 | 10/1975 | Gerner et al. | 206/462 |
| 3,924,747 | 12/1975 | Gerner | 206/531 |

FOREIGN PATENT DOCUMENTS

| | | | |
|---|---|---|---|
| 1,301,501 | 12/1972 | United Kingdom | 206/531 |

*Primary Examiner*—William Price
*Assistant Examiner*—Bruce H. Bernstein
*Attorney, Agent, or Firm*—Houston L. Swenson; Arthur R. Whale

[57] ABSTRACT

A refillable tablet package is provided through the use of a paperboard folder to which are attached removable plastic sheets containing tablets in blister receptacles.

6 Claims, 3 Drawing Figures

REFILLABLE TABLET PACKAGE

BACKGROUND OF THE INVENTION

The proper taking of certain types of medication requires a regimen that schedules tablets for several times a day. For those who are primarily at one location this is not as difficult as for those who are frequently away from their home. Thus, various designs have been developed for persons taking daily medication in forms of tablets and capsules which enable them to carry a quantity of the tablets on their person while away from home. Such containers and packages have also been designed to assist the person in remembering whether or not he has taken his two, three or four tablets a day. In some instances this has been done by a simple paperboard chart bearing the days and times right on the package adjacent the individual dosages. However, such packages have generally been designed in an unattractive manner, primarily because of the tablets or capsules that are easily visible to others as the person takes the package from his pocket or purse. Thus, a need has been recognized for an inexpensive and refillable tablet package which is attractive and will also protect the tablets as well as providing an easy means for indicating when the last tablet was consumed.

SUMMARY OF THE INVENTION

The tablet package of this invention comprises a paperboard folder in combination with at least one removable strip of separable pharmaceutical unit doses in the form of tablets or capsules. The folder comprises a unitary sheet of flexible paperboard material forming a cover panel and a back panel that is connected therewith by a retainer panel. The retainer panel is designed for removably holding the strips of pharmaceutical doses which are preferably in the form of blister receptacles containing the tablets or capsules. The retainer panel is of pleated construction with an upper layer in folding connection with an edge of the cover panel and a lower layer in folding connection with an edge of the back panel. A plurality of spaced holes are formed in the retainer panel for receiving the removable strips.

Each strip has a longitudinal stub area defined by a tear line which is positioned between the retainer and back panel and removably secured thereto by a plurality of raised projections formed in the strip. Thus, the strip containing the individual doses of tablets is retained snugly in the folder and concealed from sight until the folder is opened. The strip has perforations for individually removing a blister receptacle containing a tablet. After all the tablets have been removed from the strip, it may be discarded by separating the projections on its stub area from the spaced holes in the retainer panel. The folder may be readily refilled by simply inserting a new strip containing the individual doses of the pharmaceutical.

DESCRIPTION OF THE PREFERRED EMBODIMENT

Figure 1:
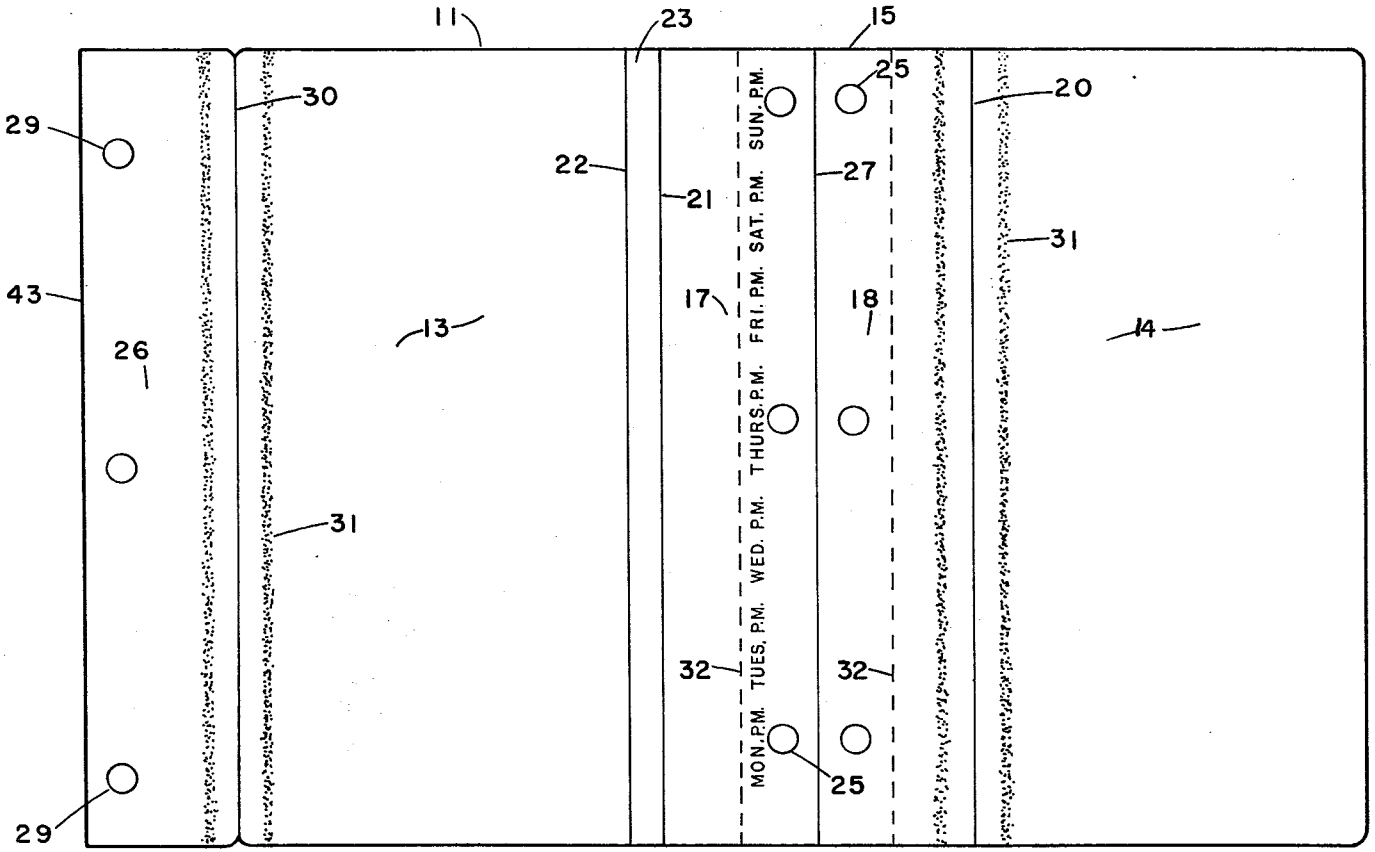
FIG. 1 is a top plan view of a paperboard blank to be used in combination with the tablet-containing strip illustrated in the top plan view of FIG. 2.
Figure 3:
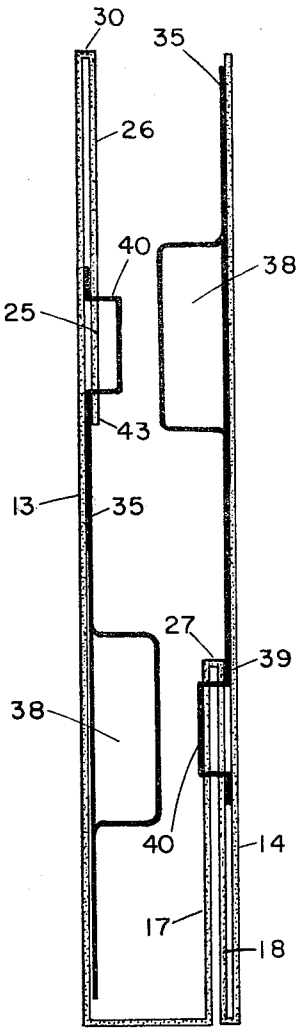
FIG. 3 is an enlarged transverse cross-sectional view of the folder and strip assembled together and positioned in a folded form.

Referring to FIG. 1, a folder 11 is illustrated which may be formed from a flexible paperboard material. The dimensions of folder 11 are arbitrary but should preferably be of such a size as to easily permit a person to carry the folder in a coat pocket or purse. The folder, which is formed from a single sheet of material, has a cover panel 13 and back panel 14 which are connected together by a retainer panel 15. Retainer panel 15 has two sections comprising an upper layer 17 and lower layer 18. A fold line 20 is formed along the length of the connection between back panel 14 and the lower layer 18 of the retainer panel. Likewise, the upper layer 17 of the retainer panel is connected to the cover panel by fold line 21. Although not necessary, it is desirable to include an additional fold line 22 and a spacing panel 23 which is of a width at least equal to the thickness of the pharmaceutical tablets or capsules. Retainer panel 15 has a plurality of holes 25 in its upper and lower layers which are positioned to coincide with each other when the two layers are folded along line 27. Although not necessary, this folder may secure a second removable strip by the addition of a fold line 30 and a second retainer panel 26. Holes 29 are provided in this panel in a manner similar to those in the first retainer panel.

To assemble this paperboard blank glue lines 31 are applied on the inside surfaces of the folder along both sides of fold lines 20 and 30. Glue lines 32 are also applied on the back side of the paperboard blank in the area between imaginary lines 32. The second retainer panel 26 may then be folded over against the inside of the cover panel and the pleated retainer panel 15 is formed by folding along lines 20 and 27 to secure the top and lower panels together as well as against the back panel 14. The folder may then be doubled over along the fold lines 21 and 22 forming the spacing panel 23 to complete its assembly.

Figure 2:
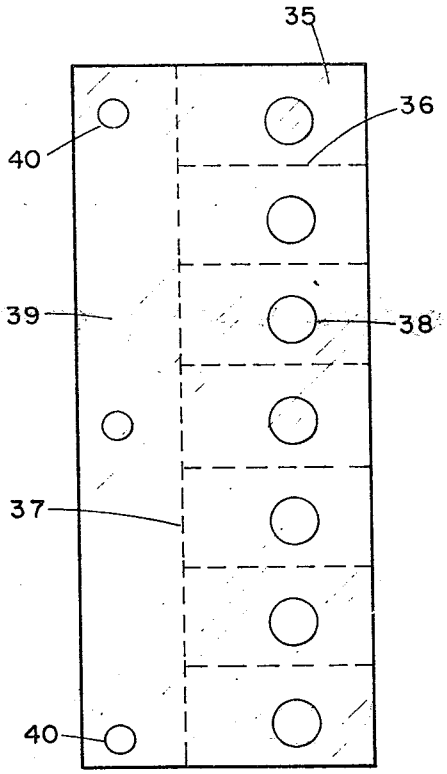

Removable strip 35, as illustrated in FIG. 2, may be formed of a transparent plastic material of a guage sufficient to provide a fair degree of rigidity. A series of perforations 36 and 37 are formed in this strip to outline the individual sections containing blister receptacles 38. Perforated line 37 defines a longitudinal stub area 39. Three projections 40 are formed in this stub which resemble buttons. These projections are dimensioned to provide a snug fit with the holes 25 in folder 11.

To assemble a strip 35 with folder 11 one need only insert the edge nearest the projections on the strip and stub 39 under the retainer panel 15 until the three projections become aligned for interlocking with holes 25. Fold line 27 is free from the back panel and yet is held in a fairly snug position against it by the glue lines to cause the removable strip to be held fairly firm in the holes. Likewise, edge 43 of the second retainer panel is free from the cover panel and yet is held fairly snugly against it by the glue lines and thereby secures the removable strip in the holes. Thus, each retainer panel has about half of its area adjacent the cover and back panels in a free position which may be slightly raised to insert and remove a strip 35. Otherwise, the interlocking and removal of projections 40 with holes 25 and 29 would be fairly difficult.

I claim:

1. A folder in combination with a removable strip of separable pharmaceutical unit doses, said folder comprising a unitary sheet of flexible material forming a cover panel connected to a back panel by a retainer panel, said retainer panel having an upper layer in folded connection with an edge of said cover panel and a lower layer in folded connection with said upper layer and an edge of said back panel, said lower layer overlying said back panel and said upper layer overlying said lower layer to form a pleated construction, said retainer panel having a plurality of spaced holes, said removable strip having a longitudinal stub area defined by a tear line separating said strip into two sections along a longitudinal axis, said stub area being positioned between said retainer and back panel and maintained therein by a plurality of raised projections on said stub area removably interlocked with said retainer panel spaced holes.

2. The combination of claim 1 in which said retainer panel is partially affixed to said back panel with said folded connection between said upper and lower layers being free from said back panel.

3. The combination of claim 2 in which said retainer panel is affixed to said back panel along a longitudinal area between said spaced holes and said folded connection between said upper and lower layers.

4. The combination of claim 3 in which said retainer panel's lower layer has an area between said spaced holes and said folded connection to said back panel glued thereto.

5. The combination of claim 4 in which said retainer panel's upper layer is glued to said lower layer.

6. The combination of claim 5 in which said cover panel has a second retainer panel having a plurality of spaced holes.

* * * * *